US005460382A

United States Patent [19]

Loritz

[11] Patent Number: 5,460,382

[45] Date of Patent: Oct. 24, 1995

[54] GAME BOARD FOR GAMES SUCH AS POGS

[75] Inventor: Kenneth Loritz, Villa Park, Calif.

[73] Assignee: Steven R. Loritz, Orange, Calif.

[21] Appl. No.: 261,702

[22] Filed: Jun. 17, 1994

[51] Int. Cl.[6] ..... A63B 67/00

[52] U.S. Cl. ..... 273/342

[58] Field of Search ..... 273/342, 178 R, 273/181 P

[56] References Cited

U.S. PATENT DOCUMENTS

| | | | |
|---|---|---|---|
| 719,456 | 2/1903 | Gailey | 273/342 |
| 2,247,852 | 7/1941 | Saunders | 273/342 X |
| 2,275,179 | 3/1942 | Heil | 273/342 |
| 2,933,318 | 4/1960 | Boynton | 273/178 R |
| 3,372,934 | 3/1968 | Heil | 273/342 |
| 3,818,628 | 6/1974 | Ensmann et al. | 273/342 X |
| 4,171,134 | 10/1979 | Reck | 374/181 R |

*Primary Examiner*—William H. Grieb
*Attorney, Agent, or Firm*—G. Donald Weber, Jr.

[57] ABSTRACT

A board game assembly wherein the board is adapted to provide a highly resilient playing surface for the game.

11 Claims, 1 Drawing Sheet

GAME BOARD FOR GAMES SUCH AS POGS

BACKGROUND

1. Field of the Invention

This invention relates to a game board, in general, and, more specifically, to a game board which provides improved game playing characteristics for playing pieces.

2. Prior Art

As a consequence of the rapidly growing phenomena related to the collection of various forms of memorabilia and, especially, trading cards, an entire new industry has developed. The trading card industry, initially fueled by the rise in popularity of collecting baseball cards, now comprises not only baseball cards, but also football, basketball, and hockey cards, as well as many other non-athletic oriented areas such as cartoon characters, celebrities, and the like. The escalation in the value of many collectibles, led by the escalation in the value of baseball cards, has generated a great interest in a number of new collectible areas and has rekindled interest in some long-dormant collectibles. The collection of milk bottle caps or juice bottle caps for hobby and profit has once again become a very popular activity. Many manufacturers of milk and juice bottle caps have become hard-pressed to keep up with the demand for these collectibles. One major contributing factor to the great popularity of bottle cap collecting among children and adults is the resurgence of a game known by various names, most commonly "The Milk Cap Game".

In the game of "Milk Caps", or as it is now popularly referred to, "POGS", a stack of bottle caps is placed on a flat, solid surface, usually the floor, but, alternatively, the sidewalk, playground, street, or the like. Each player takes turns "slamming" a heavier or weighted cap down on top of the stack. The goal of playing "POGS" is to dislodge and flip over as many of the stacked caps as possible. Typically, the caps which are turned over are captured or won by the successful participant.

The game of POGS, as with the ageless game of marbles, involves the development of certain skills which, when refined, result in players being rewarded by being able to capture an increased number of valuable caps.

The game of "POGS" has become so popular in certain parts of the country that it has replaced many traditional "street games". For example, "POGS" tournaments are held throughout the Hawaiian Islands, especially on the island of Oahu, and this activity is rapidly expanding to the United States mainland.

SUMMARY OF THE INSTANT INVENTION

This invention provides a self-contained, portable game board whereby various traditional street games, such as "POGS", may be played. By providing a portable playing surface support, the game can be played anywhere.

The game board of the instant invention exhibits a high degree of resilence which causes the game pieces to rebound more vigorously. This characteristic makes the game amenable to playing in a more convenient and exciting board game format. By utilizing the board game assembly provided by the invention, many non-traditional venues can be utilized for playing the game. The need for a large, flat surface is eliminated as the playing surface support can now be obviated.

A separate surface component provides increased resilience to the game board.

DESCRIPTION OF A PREFERRED EMBODIMENT

Figure 1:
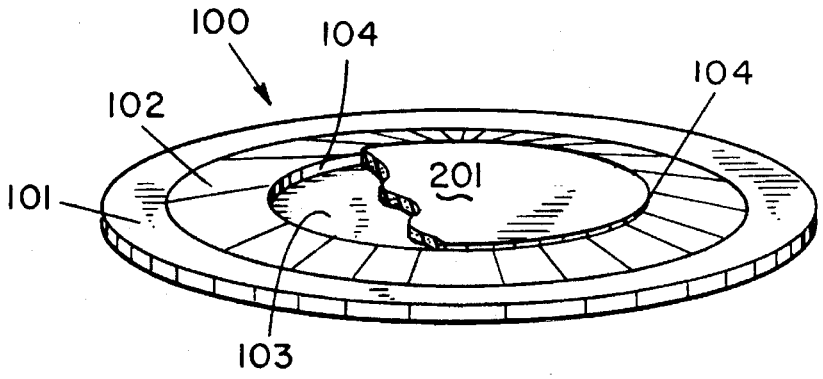
FIG. 1 is a perspective view of one embodiment of the game board playing surface support of the instant invention.

Referring now to FIG. 1, there is shown a perspective view of a preferred embodiment of the game board of the instant invention. In this embodiment, the game board 100 includes a generally frusto-conical body 102 surrounded by an elongated lip or flange 101. An upper surface 103 is disposed slightly below the upper edge of the conical wall 102. This arrangement produces an inner surface 104 which surrounds the upper surface 103.

Figure 2:
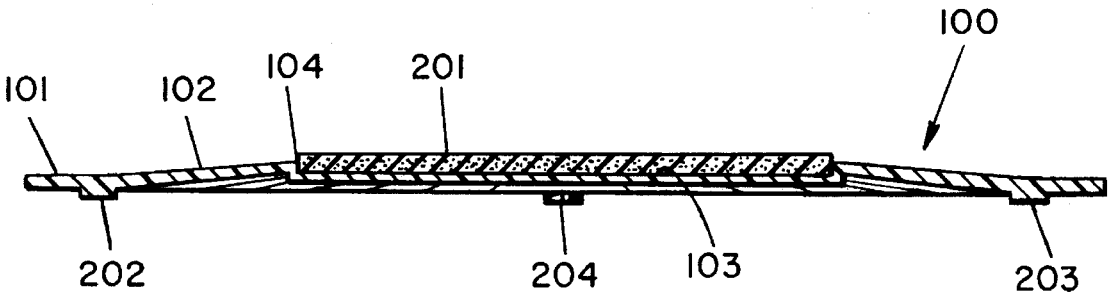
FIG. 2 is a cross-sectional view of the game board shown in FIG. 1.

Referring now to FIG. 2, there is shown a cross sectional view of game board 100 shown in FIG. 1. In this view, the frusto-conical surface 102 is angled from the lip or flange 101 and extends slightly above the upper surface 103 to thereby form the inner surface 104.

In the embodiment shown in FIG. 2, a pad 201 is disposed within the surface 104. In addition, feet or pads 202, 203 and 204 are disposed beneath flange 101 on the under surface thereof. While three such feet are shown in FIG. 2, the number of feet is limited only by a preferred design. Typically, the feet 202, 203 and 204 can be spaced around the periphery of the game board 100 in order to provide a suitable, stable support base. The number of such feet can vary. In addition, the feet can all be joined together to provide a single foot which encircles the game board beneath the flange 101. Alternatively, the feet 202, 203 and 204 can be eliminated altogether wherein the lip or flange 101 rests on a suitable surface.

The purpose of this game board is to enhance the playing of the game sometimes referred to as The Pog Game, as noted above. The frusto-conical body 102 is arranged to raise the playing area, e.g. surface 103 off the support surface. In an improved embodiment, the playing area, typically, includes the pad 201 which can be formed of a suitable resilient material such as a spongy rubber, a hard rubber or other resilient material to enhance the bounce of the game pieces which are hurled thereat. By adjusting the angle of the frusto-conical body 102, the game board itself can provide a degree of resilience in addition as that provided by pad 201 wherein the pad 201 can be omitted in some instances.

In a preferred embodiment, the outer diameter of the flange 101 is on the order of 12 inches. Of course, this dimension is variable and is not critical to the operation of the game board.

As noted, the surface 103 is spaced above the flange 101 by the conical body 102. In a typical embodiment, the pad 201 is approximately 6 inches in diameter and, typically, on the order of 1/16 to 1/4 inch thick. The pad is adapted to fit snugly on surface 103 within the confines of peripheral surface 104. Thus, the dimensions of the upper surface 103 are substantially defined.

In the typical configuration, the upper edge of frustoconical body 102 (also the upper edge of surface 104) is approximately 0.60 inches above the bottom surface of the flange 101. Thus, the slope of the frusto-conical body 102 is somewhat exaggerated in the Figures for purposed of illustration only.

Also, in the preferred embodiment, the flange areas 101 are approximately ⅛ inch. The surface 103 is, typically, also about ⅛ inch thick.

The frusto-conical surface 102 is, in a preferred embodiment, tapered from a thickness of approximately ⅛ inch at the lower end which is adjacent to (or formed with) the flange 101 and tapers to a thickness of approximately 0.093 inches thick at the upper end adjacent to the surface or wall 104. This taper arrangement causes and/or permits the game board 100 to be more flexible and to incorporate additional resilence to the apparatus whereby game pieces thrown at the game board rebound vigorously therefrom.

While it is not essential, the pad 201 can be adhered to the upper surface 103 of the game board 100 in order to avoid the pad 201 from becoming detached either during the playing of the game or in a storage operation.

In a preferred embodiment, the pad 201 is formed of a suitable dense sponge rubber such as, but not limited to, neoprene.

In a typical embodiment, the game board 100 can be formed by injection molding, thermoforming, or any other suitable fabrication technique. Thus, the game board 100 is, typically, formed of a polystyrene, polypropylene, polyethylene or any other plastic material which can be injection molded, thermoformed or extruded. The feet 202 and the like are typically formed of a material similar to the material of the pad 201 thereby providing an additional resilence to the game board.

The game board can be transparent, translucent or opaque as a function of design preference. The pad 201 can include appropriate inlays, decorative additions or the like.

A preferred embodiment of the game board is described supra. It is understood that the specific materials utilized in fabrication thereof can be altered as deemed appropriate.

In like fashion, suggested dimensions are provided. Other dimensions are certainly considered appropriate and the game board can be made larger or smaller as deemed appropriate.

Last but not least, the preferred embodiment is shown in a round or disk configuration. It is contemplated that the game board can be fabricated in virtually any shape which generally conforms with the "dome-like" configuration. That is, the frusto-conical body 102 could be substituted with a multi-sided tapering body such as a pyramidal shape or the like. Of course, the flange 101 and the surface 103 would conform thereto as well. In general, any number of sides can be used in the rising section 102 so long as the resilence and appropriate strength are retained. Generally, a board of virtually any configuration which is elevated or raised, will provide the resilence required.

Thus, there is shown and described a unique design and concept of a highly resilient game board. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A game board comprising, a flat surface, a support surface a short vertical surface connected between said flat surface and said support surface to form a cavity defined by said flat surface and said short vertical surface, said support surface joined to said flat surface via said short vertical surface at an oblique angle and adapted to maintain said flat surface elevated from any underlying surface, and a resilient pad selectively mounted in said cavity on said flat surface.

2. The game board recited in claim 1 wherein, said support structure exhibits a resilient characteristic.

3. The game board recited in claim 2 wherein, said game board has a generally frusto-conical configuration.

4. The game board recited in claim 1 wherein, said support surface is tapered to be thinner at the top end than at the bottom end.

5. The game board recited in claim 1 including, a flange extending outwardly from said support structure approximately parallel to said flat surface.

6. The game board recited in claim 5 including, support means formed on the underside of said flange.

7. The game board recited in claim 1 wherein, said resilient pad is formed of neoprene.

8. The game board recited in claim 1 wherein, said game board is fabricated of material in the class comprising polystyrene, polypropylene and polyethylene.

9. The game board recited in claim 8 wherein, said material is transparent.

10. The game board recited in claim 8 wherein, said material is opaque.

11. The game board recited in claim 1 wherein, said support surface and said flat surface comprise a unitary surface.

* * * * *